US007757546B2

(12) United States Patent
Gray et al.

(10) Patent No.: US 7,757,546 B2
(45) Date of Patent: Jul. 20, 2010

(54) CAMSHAFT AND CRANKSHAFT POSITION CORRELATION SIMULATION METHODS AND SYSTEMS

(75) Inventors: Michael David Gray, Milford, MI (US); Steven Fredrick Haller, Highland, MI (US)

(73) Assignee: GM Global Technology Operations, Inc.

( * ) Notice: Subject to any disclaimer, the term of this patent is extended or adjusted under 35 U.S.C. 154(b) by 55 days.

(21) Appl. No.: 11/966,060

(22) Filed: Dec. 28, 2007

(65) Prior Publication Data

US 2009/0165542 A1 Jul. 2, 2009

(51) Int. Cl.
*G01M 15/02* (2006.01)

(52) U.S. Cl. ..... 73/114.26

(58) Field of Classification Search ..... 73/114.02, 73/114.03, 114.24, 114.25, 114.26, 114.27, 73/114.28, 114.77, 114.79
See application file for complete search history.

(56) References Cited

U.S. PATENT DOCUMENTS 5,548,995 A * 8/1996 Clinton et al. ..... 73/114.63
5,621,644 A * 4/1997 Carson et al. ..... 701/102
6,609,498 B2 * 8/2003 Mathews et al. ..... 123/406.62
6,612,162 B2 * 9/2003 Han et al. ..... 73/114.27
7,184,880 B2 * 2/2007 Haluska ..... 701/114
7,302,835 B2 * 12/2007 Galtier et al. ..... 73/114.31
2002/0062685 A1 * 5/2002 Han et al. ..... 73/116
2006/0136118 A1 * 6/2006 Haluska ..... 701/114
2007/0012096 A1 * 1/2007 Galtier et al. ..... 73/117.3
2008/0017149 A1 * 1/2008 Kokubo et al. ..... 123/90.16

* cited by examiner

*Primary Examiner*—Eric S McCall

(57) ABSTRACT

A system designed to simulate an internal combustion engine having improper valve timing is provided. The purpose of the simulation system is to calibrate and/or validate a proprietary cam-crank correlation diagnostic algorithm. The simulation system includes a simulator module that communicates with crankshaft and camshaft position sensors and an engine control module. The simulator module includes: a first selector that selects a shift value for shifting a periodic signal; and a modification module that receives a camshaft position signal from the camshaft position sensor and that generates a modified camshaft position signal based on the crankshaft position signal and the shift value.

11 Claims, 4 Drawing Sheets

CAMSHAFT AND CRANKSHAFT POSITION CORRELATION SIMULATION METHODS AND SYSTEMS

FIELD

The present invention relates to diagnostic systems for internal combustion engines.

BACKGROUND

The statements in this section merely provide background information related to the present disclosure and may not constitute prior art.

An internal combustion engine can include one or more intake and/or exhaust camshafts that regulate the timing of intake and/or exhaust valves. A camshaft position sensor generates a camshaft position signal indicating a position of the camshaft. A control module monitors the camshaft position signal to determine engine position. The control module performs diagnostics to ensure that the engine position is reliable.

During development of the diagnostics, technicians disassemble the engine and reinstall the camshafts in a manner such that they are either advanced or retarded with respect to the crankshaft. The diagnostics are then tested to verify proper operation. For example, the diagnostics should be able to diagnose whether the rotation of the camshaft and the crankshaft are properly synchronized. This method of disassembling and reassembling the engine is costly and time consuming.

SUMMARY

Accordingly, A diagnostic system for an internal combustion engine is provided. The diagnostic system includes a diagnostic module that communicates with camshaft position sensor and an engine control module. The diagnostic module includes: a first selector that selects a shift value for shifting a periodic signal; and a modification module that receives a camshaft position signal from the camshaft position sensor and that generates a modified camshaft position signal based on the camshaft position signal and the shift value.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
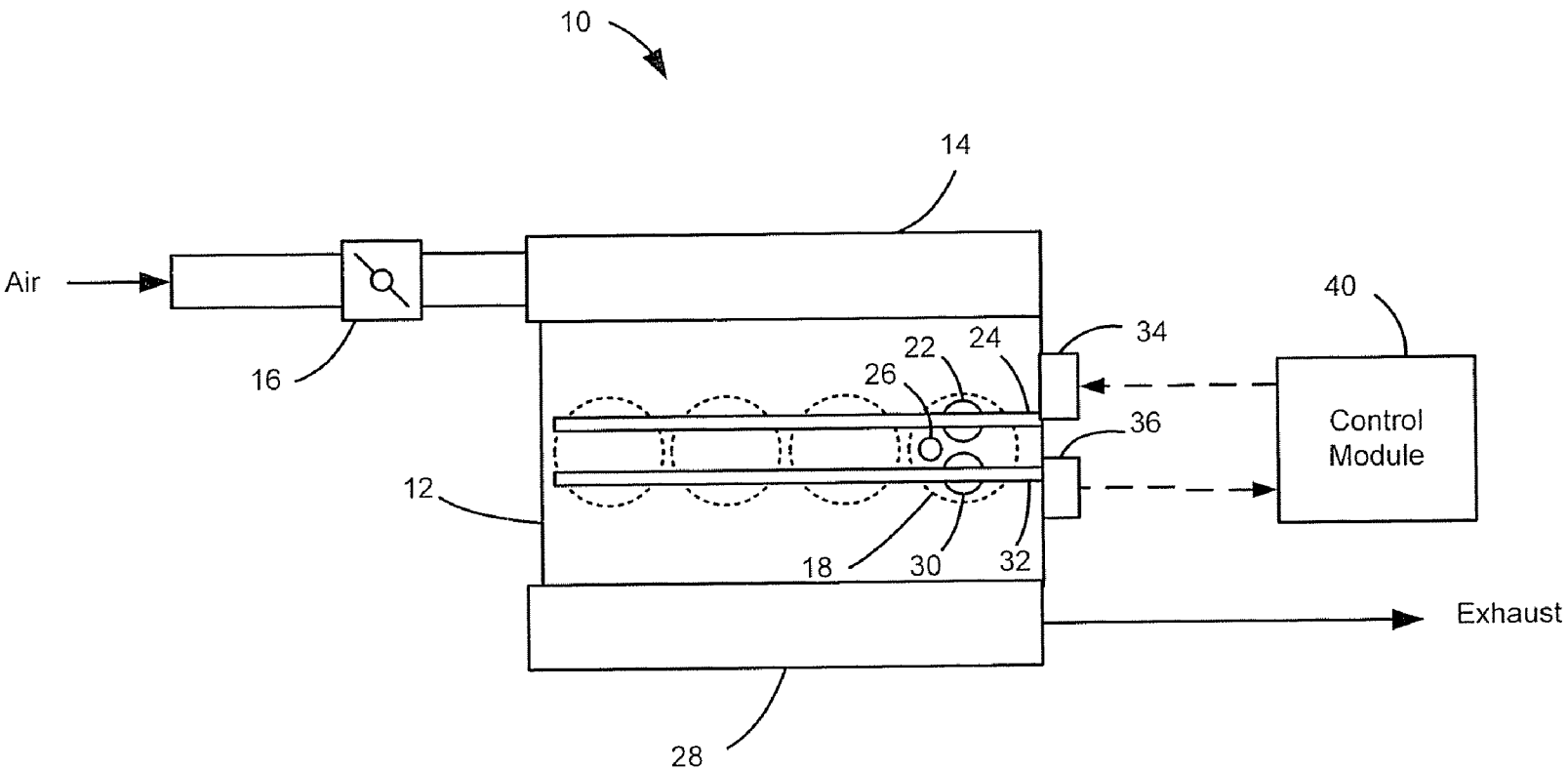
FIG. 1 is a functional block diagram of an engine system according to various aspects of the present disclosure.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring now to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although four cylinders 18 are illustrated, it can be appreciated that the engine 12 can have a plurality of cylinders 18, including, but not limited to, 2, 3, 5, 6, 8, 10, 12 and 16 cylinders.

A fuel injector (not shown) injects fuel that is combined with the air as it is drawn into the cylinder 18 through an intake port. An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 initiates combustion of the air/fuel mixture, driving the piston in the cylinder 18. The piston drives a crankshaft (not shown) to produce drive torque. Combustion exhaust within the cylinder 18 is forced out through an exhaust manifold 28 when an exhaust valve 30 is in an open position. The exhaust valve position is regulated by an exhaust camshaft 32. The exhaust gas flows into an exhaust system (not shown). Although single intake and exhaust valves 22,30 are illustrated, it can be appreciated that the engine 12 can include multiple intake and exhaust valves 22,30 per cylinder 18.

The engine system 10 can include an intake cam phaser 34 and/or an exhaust cam phaser 36 that respectively regulate the rotational timing of the intake and exhaust camshafts 24,32. More specifically, the timing or phase angle of the respective intake and exhaust camshafts 24,32 can be retarded or advanced with respect to each other or with respect to a location of the piston within the cylinder 18 or crankshaft position. In this manner, the position of the intake and exhaust valves 22,30 can be regulated with respect to each other or with respect to a location of the piston within the cylinder 18. By regulating the position of the intake valve 22 and the exhaust valve 30, the quantity of air/fuel mixture ingested into the cylinder 18 and, therefore, the engine torque is regulated. A control module 40 controls the phase angle of the intake cam phaser 34 and exhaust cam phaser 36 based on a desired torque.

Figure 2:
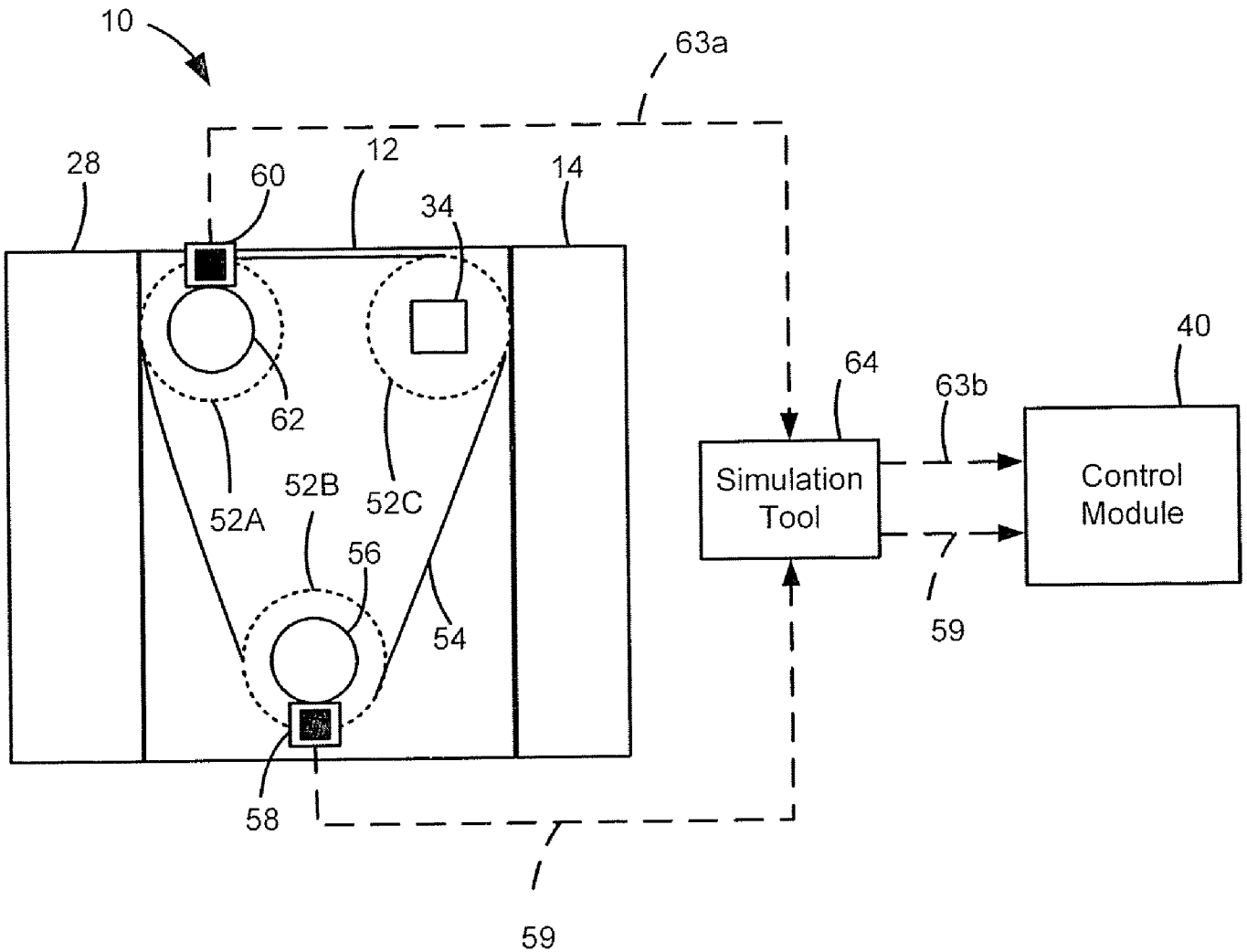
FIG. 2 is a functional block diagram of the engine system of FIG. 1 including a correlation simulation module according to various aspects of the present disclosure.

Referring now to FIG. 2, a side view of the engine system 10 is shown. The exhaust camshaft 32 (FIG. 1) and the intake camshaft 24 (FIG. 1) are coupled to the crankshaft (not shown) via sprockets 52A, 52B, and 52C and a timing chain 54. The engine system 10 outputs a crankshaft signal 59 indicating the position of the crankshaft. The crankshaft signal 59 is generated by the rotation of a wheel 56 coupled to the crankshaft. The wheel 56 can have a plurality of teeth. A crankshaft position sensor 58 senses the teeth of the wheel and generates the crankshaft signal 59 in a periodic form. The control module 40 decodes the crankshaft signal 59 to a specific tooth number of the wheel 56. The crankshaft position is determined from the decoded tooth number of the wheel 56.

Similarly, a camshaft position sensor 60 senses the teeth of a wheel 62 coupled to the exhaust camshaft 32 (FIG. 1) and generates a camshaft signal 63*a*. A camshaft position is determined from the camshaft signal 63*a*. As can be appreciated, a wheel (not shown) and camshaft position sensor (not shown) can be coupled to the intake camshaft 24 (FIG. 1), either additionally or alternatively. From the camshaft position and the crankshaft position, the control module 40 can determine an overall engine position. In addition, the control module 40 can diagnose the operation of the exhaust camshaft 32 and crankshaft.

To verify proper operation of the diagnostics performed by the control module 40 and/or to permit calibration development, a correlation simulation module 64 can be disposed between the camshaft position sensor 60, the crankshaft sensor 58, and the control module 40. The correlation simulation module 64 permits real-time modification of the camshaft position signal 63*a*. The modification can have a selectable magnitude.

Figure 3:
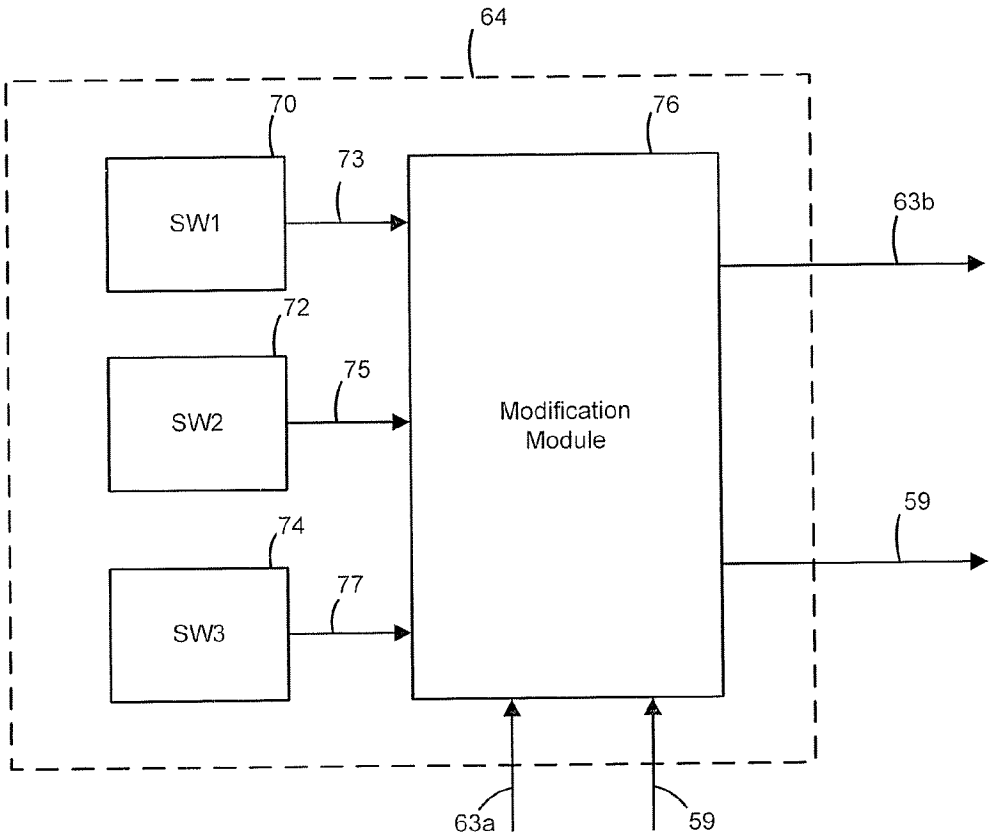
FIG. 3 is a functional block diagram illustrating the correlation simulation module of FIG. 2 according to various aspects of the present disclosure.

In an exemplary embodiment, as shown in FIG. 3 and with continued reference to FIG. 2, the correlation simulation module includes one or more selectors such as a switches (e.g., rotary switches) that allow an operator to selectively alter the camshaft signal 63*a*. In various other embodiments, the selectors can be implemented by other selection devices, such as, the use of jumpers or potentiometers.

In various embodiments, a first selector 70 selects which camshaft signal 63*a* to be modified (for engine systems 10 with more than one camshaft sensor 60). A second selector 72 selects the number of teeth or a pulse value by which the camshaft signal 63*a* is to be shifted. A third selector 74 selects whether the camshaft signal 63*a* is to be advanced or retarded.

A modification module 76 receives as input the crankshaft signal 59, a signal 73 indicating the camshaft signal 63*a* to be modified, a signal 75 indicating the number of teeth by which to shift the selected camshaft signal 63*a*, and a signal 77 indicating whether to advance or retard the selected camshaft signal 63*a*. The modification module 76 monitors the crankshaft signal 59 for a position of the crankshaft and the number of teeth per revolution of the wheel 56. In various embodiments, the modification module 76 maintains a memory of the selected camshaft signal 63*a* waveform for each revolution. Based on the selected inputs 73, 75, and/or 77 and the stored waveform, the modification module 76 generates a modified camshaft signal 63*b*. In various embodiments, the modified camshaft signal 63*b* is either retarded or advanced relative to the crankshaft signal 59 by the selected pulse value or number of teeth.

Figure 4:
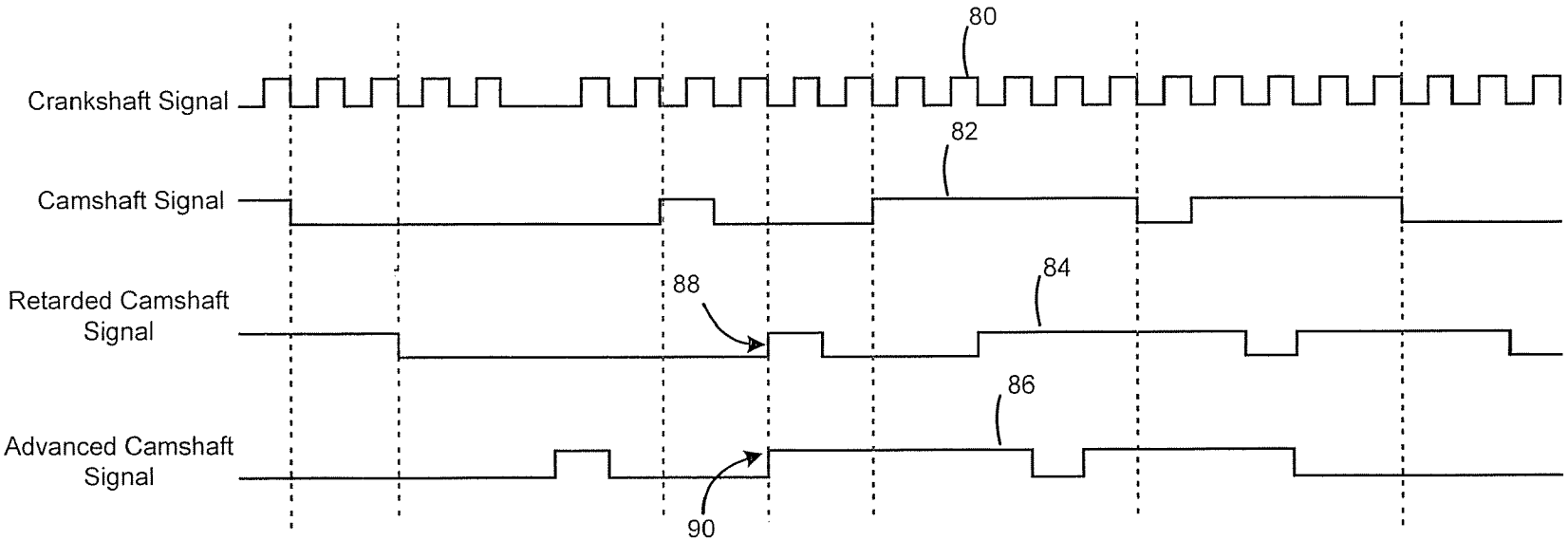
FIG. 4 is an illustration of modified camshaft position signals generated by the correlation simulation module according to various aspects of the present disclosure.

For example, as shown in FIG. 4 and with continued reference to FIGS. 2 and 3, an exemplary crankshaft signal 59 is shown at 80. An exemplary camshaft signal 63*a* is shown at 82. Modified camshaft signals are shown at 84 and 86. When "two teeth" and "retarded" are the selected inputs, the modification module 76 generates a modified camshaft signal 84 that is retarded by two pulses or teeth as shown at 88. When "two teeth" and "advanced" are the selected inputs, the modification module 76 generates a modified camshaft signal 86 that is advanced by two pulses or teeth as shown at 90. The modified camshaft signal 63*b* and the crankshaft signal 59 are output to the control module 40 for diagnosing. The modified camshaft signal 63*a* allows the control module 40 to diagnose errors without altering engine system components.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. A diagnostic system for an internal combustion engine, comprising:

a diagnostic module that communicates with camshaft position sensor and an engine control module, that is located externally to the camshaft position sensor and the engine control module, and that includes:

a shift selector that selects a shift value for shifting a periodic signal; and a modification module that receives a camshaft position signal from the camshaft position sensor and that generates a modified camshaft position signal based on the camshaft position signal and the shift value.

2. The system of claim 1 wherein the modification module receives a crankshaft position signal and shifts the camshaft position signal relative to the crankshaft position signal to generate the modified camshaft position signal.

3. The system of claim 1 wherein the modification module generates the modified camshaft position signal during operation of the internal combustion engine.

4. The system of claim 1 further comprising a direction selector that selects a shift direction indicating at least one of advance and retard, wherein the modification module generates the modified camshaft position signal based on the shift direction.

5. The system of claim 1 further comprising a signal selector that selects the camshaft position signal from a plurality of camshaft position signals.

6. The system of claim 1 wherein the modification module generates the modified camshaft position signal by maintaining a memory of the camshaft position signal per revolution of a camshaft position wheel and by shifting the memorized camshaft position signal by the shift value.

7. An engine system, comprising:

a camshaft position sensor that generates a camshaft position signal;

a crankshaft position sensor that generates a crankshaft position signal;

a modification module that receives the camshaft position signal and the crankshaft position signal and that generates a modified camshaft position signal by shifting the camshaft position signal relative to the crankshaft position signal; and a control module that receives the modified camshaft position signal and that diagnoses the internal combustion engine based on the modified camshaft position signal, wherein the modification module is located externally to the camshaft position sensor, the crankshaft position sensor, and the control module.

8. The system of claim 7 further comprising:

a plurality of camshaft position sensors that generate a plurality of camshaft position signals; and a signal selector that selects the camshaft position signal from the plurality of camshaft position signals.

9. The system of claim 7 further comprising a shift selector that selects a shift value indicating a pulse number to shift the camshaft position signal, and wherein the modification module generates the modified camshaft position signal based on the shift value.

10. The system of claim 7 further comprising a direction selector that selects a shift direction indicating at least one of advance and retard, and wherein the modification module generates the modified camshaft position signal based on the shift direction.

11. A simulation system for an internal combustion engine, comprising:

a simulator module that selectively connects between a plurality of camshaft position sensors and an engine control module, the simulation module comprising:

a shift selector that selects a shift value indicating a pulse number to shift a periodic signal;

a direction selector that selects a shift direction indicating at least one of advance and retard;

a signal selector that selects a first camshaft position signal from a plurality of camshaft position signals; and a modification module that receives the first camshaft position signal from a first camshaft position sensor of the plurality of camshaft position sensors and that generates a modified camshaft position signal based on the first camshaft position signal, the shift value, and the shift direction.

* * * * *